United States Patent [19]

Hirai et al.

[11] Patent Number: 4,880,952

[45] Date of Patent: Nov. 14, 1989

[54] HEAT COOKING OVEN HAVING FLAT HEATER UNITS ON THE OUTSIDE OF THE WALLS THEREOF

[75] Inventors: Kazumi Hirai, Nabari; Mitsuo Akiyoshi, Nara; Yoshio Mitsumoto, Kashihara; Ichiroh Hori, Yamatokoriyama, all of Japan

[73] Assignee: Matsushita Electrical Industrial Co., Ltd., Osaka, Japan

[21] Appl. No.: 328,772

[22] Filed: Mar. 24, 1989

Related U.S. Application Data

[63] Continuation of Ser. No. 251,951, Sep. 29, 1988, abandoned, which is a continuation of Ser. No. 71,528, Jul. 8, 1987, abandoned, which is a continuation of Ser. No. 853,219, Apr. 17, 1986, abandoned.

[30] Foreign Application Priority Data

| | | | |
|---|---|---|---|
| Apr. 17, 1985 | [JP] | Japan | 60-81666 |
| Apr. 30, 1985 | [JP] | Japan | 60-93046 |
| May 14, 1985 | [JP] | Japan | 60-101852 |

[51] Int. Cl.[4] ..... H05B 6/64

[52] U.S. Cl. ..... 219/10.55 B; 219/10.55 E; 219/407; 126/275 E

[58] Field of Search ..... 219/10.55 B, 10.55 R, 219/10.55 E, 407, 406, 403, 396, 393; 126/19 R, 275 E

[56] References Cited

U.S. PATENT DOCUMENTS

| | | | |
|---|---|---|---|
| 2,505,117 | 4/1950 | Hoffman . | |
| 3,155,814 | 11/1964 | Appleman et al. | 219/407 |
| 3,350,493 | 10/1967 | Randall | 219/407 X |
| 3,962,561 | 6/1976 | Maitenaz | 219/393 X |
| 3,979,575 | 9/1976 | Maahs | 219/407 |
| 4,392,038 | 7/1983 | Day et al. | 219/10.55 R X |
| 4,453,064 | 6/1984 | Toyoda et al. | 219/10.55 E X |
| 4,455,319 | 6/1984 | Clark | 126/19 R X |
| 4,542,268 | 9/1985 | Jarvis et al. | 219/10.55 B |
| 4,675,507 | 6/1987 | Akiyoshi et al. | 219/406 |
| 4,745,246 | 5/1988 | Hori et al. | 219/10.55 B |

FOREIGN PATENT DOCUMENTS

| | | |
|---|---|---|
| 0199264 | 10/1986 | European Pat. Off. . |
| 14469 | of 1915 | United Kingdom . |

*Primary Examiner*—Philip H. Leung

*Attorney, Agent, or Firm*—Wenderoth, Lind & Ponack

[57] ABSTRACT

This invention relates to a heat cooking apparatus having a flat heater firmly attached to an outside surface of the wall surface of the heating chamber the flat surface being composed of flatly configured heating elements with a heat-proof insulator therebetween. Also, by forming a non-metallic layer on the inner surface of the metallic wall surface facing the heating elements, heat from the heater is efficiently and uniformly conducted so as to perform uniform heating and high heat-cooking efficiency.

2 Claims, 4 Drawing Sheets

HEAT COOKING OVEN HAVING FLAT HEATER UNITS ON THE OUTSIDE OF THE WALLS THEREOF

This application is a continuation of now abandoned application Ser. No. 251,951, filed Sept. 29, 1988, which was a continuation of application Ser. No. 071,528, filed July 8, 1987, now abandoned, which in turn was a continuation of now abandoned application Ser. No. 853,219, filed Apr. 17, 1986.

BACKGROUND OF THE INVENTION

This invention relates to a heat cooking apparatus which heats and cooks a food material in a heating chamber under heat supplied by an electric heater such as an electric oven or a microwave oven with a heater.

The conventional techniques and their problems relating to a heat cooking apparatus are described according to examples as shown in FIGS. 1 to 3.

A cross-sectional view of a conventional heat cooking apparatus is shown in FIG. 1, which illustrates heating chamber 1 comprising upper heater 2, lower heater 3 and pan 4 with food 5 on it to be heated and cooked. Furthermore, FIG. 1 shows magnetron 6 which irradiates microwaves into heating chamber 1 via waveguide 7 to heat food 5; thus the apparatus is an open cooking range employing so-called compound heat of a heater and microwaves.

FIG. 2 is a perspective view of a conventional heater element of a heat cooking apparatus, which is the structure of an openly installed upper heater 2 and lower heater 3 in heating chamber 1. The disadvantage with this structure is that the effective capacity of the heating chamber is reduced because of the volume of the heater, thus resulting in an inconvenience for heating a large-sized article of food. In order to accommodate large-sized food articles, conventional heating chambers must be made larger because of the heater, and consequently, the external dimension of a conventional heating apparatus is made larger requiring a larger space for it to be installed, thus making it inconvenient to use.

Moreover, this kind of heater configuration makes it difficult to clean the inside parts of the heating chamber, e.g. scattered food on the heating chamber wall surface, which also causes this type of conventional heat cooking apparatus to be inconvenient to use.

A conventional-type rod heater makes it difficult to perform uniform heating because the heater applies heat only to the limited area which the heater covers such that the food is thus scorched in the pattern of the heater.

A cross-sectional view of another conventional heat cooking apparatus is shown in FIG. 3, in which the same parts as in FIG. 1 are indicated by the same number and their descriptions thereof are omitted.

In FIG. 3, the upper heater 8 and the lower heater 9 are installed respectively on the outside of the wall of the heating chamber 1, which heats only the heater-contact area of the wall, and accordingly only the heat applied to this area can be conducted into the heating chamber, resulting in that heat conduction efficiency is poorly achieved, resulting in consumption of a great amount of electric power. Such a disadvantage must be avoided from the energy-saving point of view.

SUMMARY OF THE INVENTION

With regard to the disadvantages mentioned above, an essential object of this invention is to provide a high-performance heat cooking apparatus which is free from the conventional defects, has efficient heat conduction, is easy to use because the heat chamber is spacious, and moreover, has uniform heating performance.

According to this invention, the heat cooking apparatus comprises a heating chamber for accommodating food and having walls of steel, a flat, plane heater which is flatly installed on the outside surface of the heating chamber wall by a heat-proof insulator, and a plane non-metallic layer which is flatly provided on the inside surface of the heating chamber wall at a portion facing the heater through the steel plate of the heating chamber wall.

Moreover, an aluminum layer is formed on the wall surface facing the heater, and the non-metallic layer of the inner metallic wall surface is provided with a self-cleaning function to enhance heat efficiency.

The heat generated by the heater installed on the outside surface of the heating chamber with a heat-proof insulator is conducted to the metal plate forming the outside wall surface of the heating chamber, and by irradiating the heat from the metal plate into the heating chamber, the food material is heated. The metal plate of the inside surface of the heating chamber is coated with a non-metallic material such as ceramic, and, consequently, non-metallic superficial irradiation is performed on the layer surface whose emissivity increases to over 0.5, i.e., the value of irradiation is larger than that of the metallic surface and the superficial irradiation efficiency is enhanced, which effectively irradiates the metal plate to heat the food material.

The aluminium coating on the wall surface facing the heater performs adequate heat conduction and the temperature of the metal plate is immediately made uniform, and, thus, the heat irradiation efficiency of the metal plate is still further enhanced and heating efficiency is also enhanced. Accordingly, the food material is effectively heated by this function even if it is placed outside the heating chamber, and of course a uniform degree of cooking can be obtained because of uniform heat distribution. In addition, since the openly-installed heater is not present in the heating chamber, the effective spacious capacity of the heating chamber becomes larger and the cleaning operation becomes easier, and, thus, this heat cooking apparatus system is much more convenient to handle. Furthermore, the black self-cleaning layer on the inside surface of the metal plate can perform not only a function of non-metallic superficial irradiation and blackbody irradiation but also has a self-cleaning function so that it performs a compound-function.

BRIEF DESCRIPTION OF THE DRAWINGS

These and other objects and features of the present invention will become apparent from the following description of a preferred embodiment with reference to the accompanying drawings, in which.

DETAILED DESCRIPTION OF THE EMBODIMENTS

Figure 1:
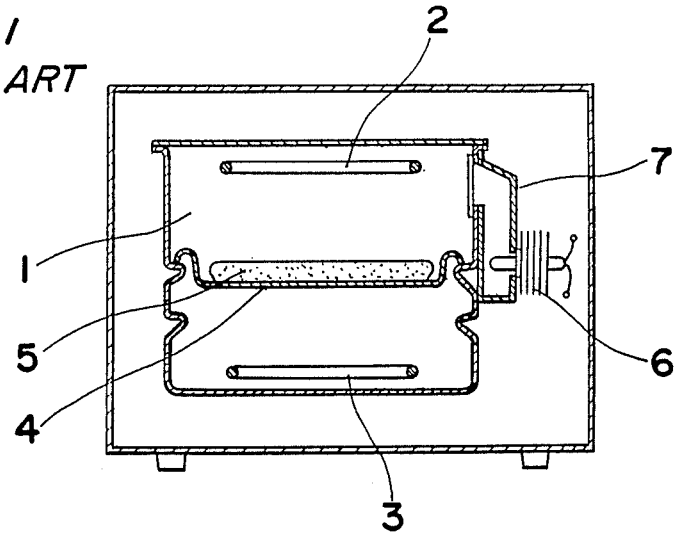
Fig. 1 PRIOR ART
FIG. 1 is a cross-sectional view of the conventional type heat cooking apparatus, as already referred to above.
Figure 2:
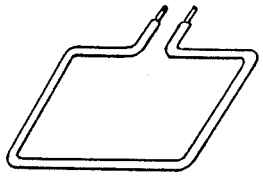
Fig. 2 PRIOR ART
FIG. 2 is a perspective view of a heater for use in the heat cooking apparatus of FIG. 1.
Figure 3:
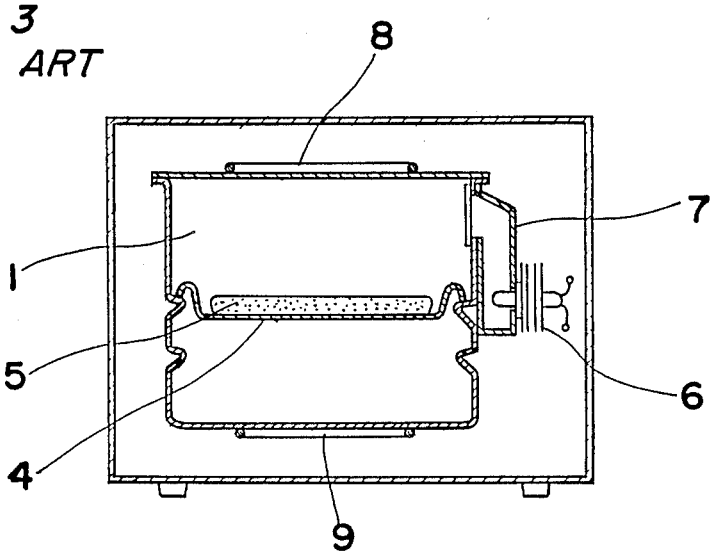
Fig. 3 PRIOR ART
FIG. 3 is a cross-sectional view of a similar heat cooking apparatus to that of FIG. 1.

Before the description of the present invention proceeds, it is to be noted that like parts are designated by like reference numerals throughout the accompanying drawings.

The heat cooking apparatus according to one preferred embodiment of this invention is shown in FIGS. 4 to 7, which will be described in detail hereinafter.

Figure 4:
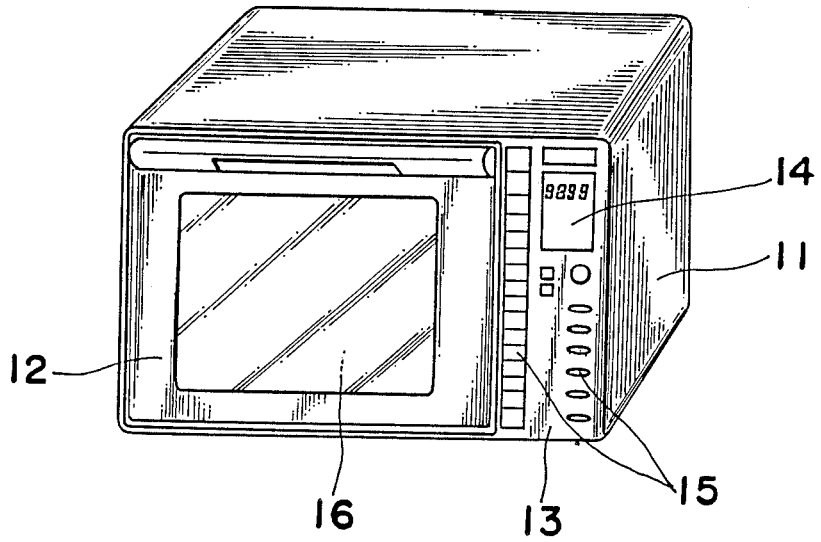
FIG. 4 is a perspective view of a heat cooking apparatus according to one embodiment of this invention.
Figure 5:
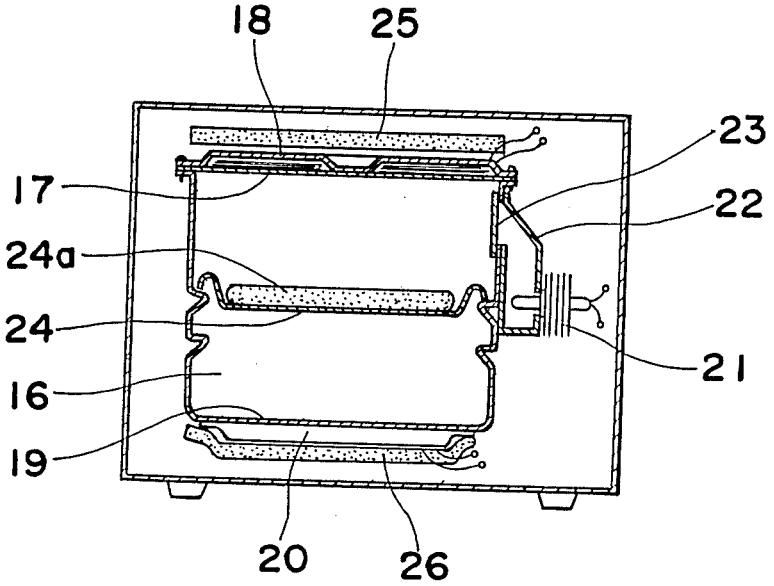
FIG. 5 is a cross-sectional view of the heat cooking apparatus of FIG. 4.

In FIG. 4, a door 12, which can be freely opened and closed, is installed in the front part of a heat cooking apparatus housing 11 having an operation panel 13, a display board 14 is installed in the panel 13 to display the timetable for heating, and an operation key 15 is provided on the operation panel, the door 12 being opened for setting a food material in a heating chamber 16 provided in the housing 11. In FIG. 5, an upper heater 18 is attached to the outside surface of upper wall 17 of the heating chamber 16, and a lower heater 20 is attached to the outside surface of lower wall 19. A magnetron 21 is provided with an oscillator, which irradiates food material 24*a* on pan 24 in heating chamber 16 through opening 23 via waveguide 22, and heat insulators 25 and 26 serve as shields for shielding the housing 11 against heat from the heater.

Figure 6:
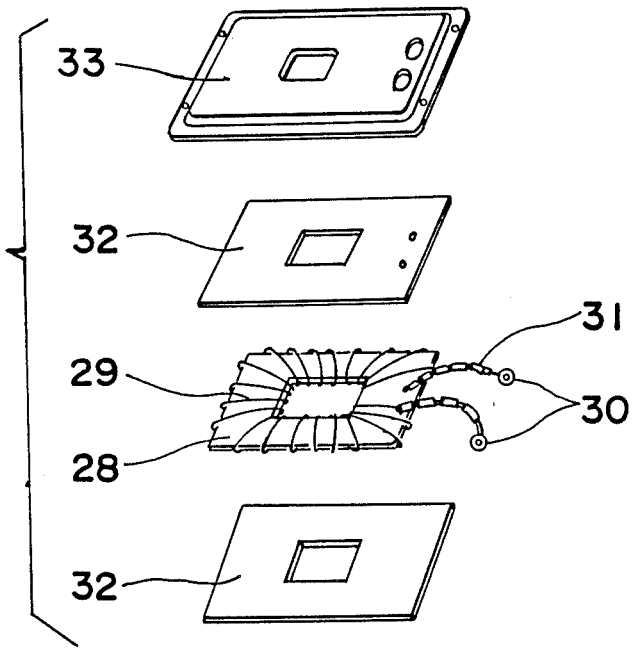
FIG. 6 is an exploded perspective view showing the compound of heater portion of the heat cooking apparatus of FIG. 5.
Figure 7:
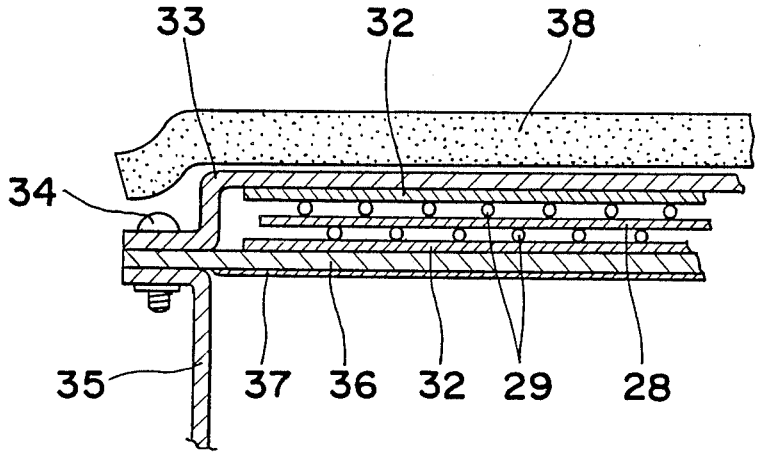
FIG. 7 is a cross-sectional view, on an enlarged scale, showing the heater portion of FIG. 6 mounted on an oven.

In FIG. 6 and FIG. 7, a flat core 28, composed of a heat-proof insulator such as mica, is has a heating element 29 coiled flatly therearound and the element 29 has lead wires 30 insulated by an insulator 31.

Insulators 32, composed of a heat-proof electrical insulator material such as mica, are mounted on at the upper and lower surface of core 28, and thus the turns of the heating elements 29 are held between insulating sheets 32. The upper surface or the upper most insulating sheet 32 contacts a metal keep-plate 33 which is fixed to a heating chamber body 35 by a screw 34. The surface of the heating chamber wall 36 facing the heating element 29 is made of a metal plate such as steel, and its inside surface is coated with non-metallic layer 37, which is formed by coating with a non-metallic and high heat emissive heat-resistance material such as heat-resistant paint, heat-resistant enamel, or ceramic paint. Non-metallic layer 37 should be formed at least on the inside surface of heating chamber, although, if it is formed on both surfaces of the wall, the heat-proof effectiveness is greatly enhanced. The preferable colors for non-metallic layer 37 are colors such as black, dark gray, dark blue and dark brown, since these colors make the surface emissivity effective. A heat insulator 38 is provided over the outside of keep-plate 33 to prevent the heat loss from the heating element.

Figure 8:
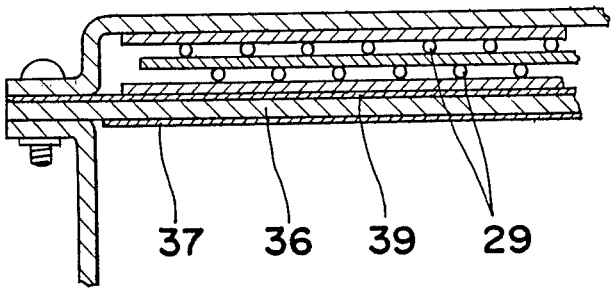
FIG. 8 to FIG. 10 are respectively cross-sectional views, similar to FIG. 7, each showing the heater structure of other embodiments of this invention.

FIG. 8 is a cross-sectional view of a portion of a heat cooking apparatus, according to another embodiment of this invention, in which the inner surface of heating chamber 36 is coated with non-metallic layer 37 and the outer surface is coated with an aluminum layer 39.

Figure 9:
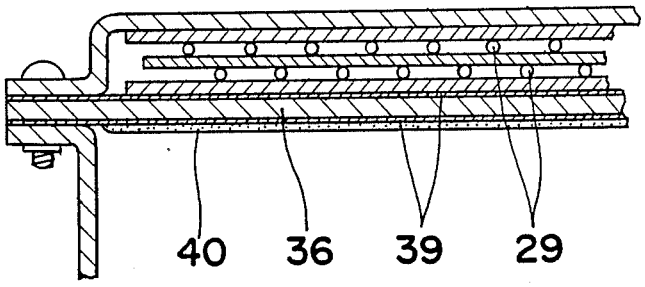

FIG. 9 is a cross-sectional view of a portion of a heat cooking apparatus, according to a further embodiment of this invention, in which both surfaces of heating chamber 36 are coated with the aluminum layer 39, and the inside surface of the heating chamber is coated with a layer capable of decomposing by means of catalytic action or a non-metallic self-cleaning layer 40, which can be formed directly on the heating chamber wall surface without forming an aluminum layer 39, and having the ability to clean dirt by burning at high temperature, the color of this self-cleaning layer preferably being black.

The heat of heating element 29 travels through insulating sheet 32 to heating chamber 36 and then travels through aluminum layer 39, non-metallic layer 37 and self-cleaning layer 40 respectively, resulting in that the food material is heated by heat-radiation from the heating chamber inner-surface into the heating chamber.

Figure 10:
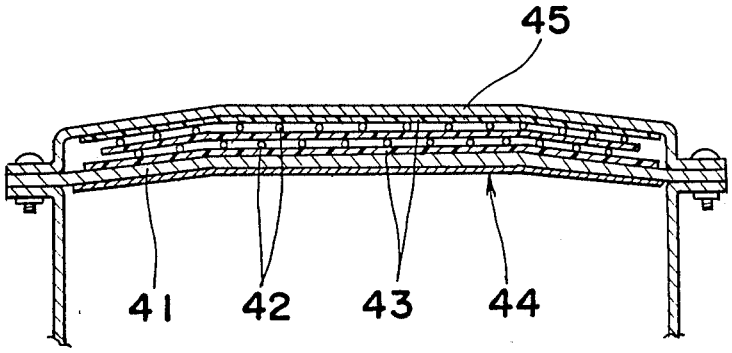

FIG. 10 is a cross-sectional view of a portion of a heat cooking apparatus, according to a still further embodiment of this invention, in which the heating element 42 is nipped by heat-proof insulator 43 to form a flat heater at the upper part of the upper-wall surface of heating chamber, and the inside surface of the upper-wall of the heating chamber is coated with non-metallic layer 44. The upper-wall surface 41 of the heating chamber is constructed to form a U-shape on the side of non-metallic layer 44, so that energizing heating element 42 to raise the heater temperature will help to increase the U-shape of the upper-wall surface of the heating chamber as well as the elongation of the upper side of the upper-wall surface 41 of heating chamber, and thus the keep-plate 45 presses the heater more firmly so as to exert improved heat conduction and less heat deformation of the upper-wall surface 41 of heating chamber regulated by the keep-plate 45, and, accordingly, the stress applied to non-metallic layer 44 becomes smaller, resulting in enhanced durability.

The heat cooking apparatus of this invention described above can provide the following advantages:

(1) The heating element is flat against the chamber wall to uniformly conduct heat to the heating chamber, and thus the food material can be heated uniformly. In addition, the whole heating chamber wall surface serves as a heat-conducting surface to conduct a great quantity of heat, and, consequently, effective heat application is possible even if the heating element is located outside the heating chamber. Heat from the heating element is conducted to the wall surface of heating chamber via an insulator, and the inside wall surface of heating chamber is coated with a non-metallic layer to perform non-metallic radiation from its surface whose emissivity is 0.5 or over, which is far higher than that of the metallic surface, whereby the heat from the heating chamber can be effectively irradiated to the food material. Heat rays, which have a relatively long wavelength as compared to infrared rays and are easily absorbed by the food material, are irradiated from the heating chamber wall surface, so that high-performance heating efficiency can be obtained as a result of this point.

(2) The above-described heating efficiency can be enhanced all the more by coating the inside surface of heating chamber with a non-metallic layer and the outside surface with an aluminum layer whereby the heat of the heating element, conducted to aluminum layer via an insulating sheet, is uniformly conducted to the whole surface through the aluminum layer. The heat conduction from the aluminum layer to the metal plate, comprising the heating chamber wall surface, is performed through the total surface of the metal plate, therefore, the greater the heat conduction area, the better the heat conduction becomes; thus, heating efficiency can be enhanced by the synergistic effect of non-metallic irradiation and blackbody irradiation.

(3) As the heat conduction is excellent, the heat of the heating element can be efficiently transmitted to heat the wall surface of the heating chamber, so that, even if the heating element is installed outside the heating chamber, it can effectively perform heat application, and as a result of this invention, the heating efficiency and energy-saving improve compared with the conventional types which have heating elements installed on the outside, and which require a great amount of electricity for heating.

(4) Compared with a conventional type the heater of which is installed inside the heating chamber, the heating chamber of this invention is spacious and free from protruding portions, which makes it very easy to clean and operate, even if the food material is scattered around the heating chamber wall.

(5) The effective spacious capacity of the heating chamber increases corresponding the space occupied by the heater making it possible to cook large food articles, and if the provided heating chamber capacity is the same, this invention can make the external shape of the apparatus smaller than that of the conventional type and thus can provide a compact and easy-to-use heat cooking apparatus.

(6) Heat from the heating element is uniformly conducted to the total internal space of the heating chamber through the metal plate of the wall surface of the heating chamber or the aluminum layer, whereby uniform heating and even cooking become possible.

(7) The irradiation effect can be enhanced by synergistic effect of non-metallic irradiation and blackbody irradiation by making the inside wall of heating chamber a dark color, so that dirt is hard to see, and furthermore if the self-cleaning layer is added, dirt is self-purified which keeps the heating chamber constantly clean and makes it hygienic, unnecessary to clean, and still easier to use. As the heating element heats the total wall surface of the heating chamber, the total self-cleaning layer uniformly becomes very hot to provide a catalytic effect and make the purification effect extremely efficient.

(8) The non-metallic, aluminum and self-cleaning layers are formed to provide excellent corrosion resistance, high-performance, durability and sturdiness of the heat cooking apparatus. Moreover, a steel plate can be used for the material of metal plate, and, thus, materials cost is lower than that for materials such as stainless steel. Furthermore, workability is made easier, and an economical system is achievable.

(9) The heating chamber wall surface, on which the flat heater is installed, is formed a U-shape so as to curve convexly in the flat heater direction when heated, and as a result of this process, it firmly presses the flat heater, resulting in further improving the heat conduction.

Therefore, the heat apparatus of this invention provides enhanced heating performance including heating efficiency and uniform heating, and, also, a efficient heating chamber cleaning function. The technique of this invention can be employed in a heat cooking apparatus such as an electric oven that cooks food materials by applying heat to the heating chamber with an electric heater, or a microwave oven with a heater.

Although the present invention has fully been described in connection with the preferred embodiment thereof, it is to be noted that various changes and modifications will be apparent to those skilled in the art. Accordingly, such changes and modifications are to be understood as included within the scope of the present invention as defind by the appended claims, unless they depart therefrom.

What is claimed is:

1. A heat cooking apparatus comprising:

a heating chamber for accommodating food material to be heated therein and having a front opening and metal walls defining all but one of the remainder of the walls of said heating chamber, said metal walls each having an outwardly turned flange along the edge thereof at the location of said one wall of the chamber;

a heater carrying wall constituting said one wall of said chamber and having the peripheral edge engaged with the flanges of the said metal walls, said heater carrying wall being of metal and having a layer of black non-metallic self-cleaning material which has a high heat emissivity of at least 0.5 coated thereon on the surface thereof facing the interior of said heating chamber;

a flat heater unit on the side of said heater carrying wall facing away from the interior of said heating chamber, said heater unit having a plurality of thin sheets of an electric insulator material having good heat resistance at the temperatures necessary for cooking food within said heating chamber, one of said sheets being positioned on the side of said heater unit toward said heater carrying wall and a resistance heater constituted by at least one heating wire on the side of said one sheet away from said heater carrying wall, the heating wire being mounted between said thin sheets for giving the heater unit a flat shape;

a retainer plate over the thin sheet remote from said heater carrying wall and having flanges overlying the edge of said heater carrying wall which is against the flanges of said metal walls;

fastening means fastening said flanges on said metal walls, the edge of said heater carrying wall and said flanges on said retainer plate together for mounting said heater carrying wall on said metal walls to complete said heating chamber and for holding said retainer plate firmly against said flat heater unit to hold said flat heater unit against said heater carrying wall; and means for supplying microwave radiation into said heating chamber.

2. A heat cooking apparatus as claimed in claim 1 wherein the surface of said heating chamber wall coated with the non-metallic layer is concave.

* * * * *